US006352168B1

(12) United States Patent
Lin

(10) Patent No.: US 6,352,168 B1
(45) Date of Patent: Mar. 5, 2002

(54) ROTATION CUP

(76) Inventor: Jung-Chuang Lin, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/887,987

(22) Filed: Jun. 21, 2001

(51) Int. Cl.[7] ..... B65D 81/38

(52) U.S. Cl. ..... 220/592.17; 220/8; 220/23.88; 220/23.9

(58) Field of Search ..... 220/592.16, 592.17, 220/8, 23.88, 23.87, 23.91, 23.9

(56) References Cited

U.S. PATENT DOCUMENTS

RE25,618 E * 7/1964 Goodman ..... 220/592.17
4,273,245 A * 6/1981 Hartinger Machalek ..... 220/592.17
5,011,009 A * 4/1991 Scheurer ..... 220/8
5,078,287 A * 1/1992 Holmes, III ..... 220/8
6,094,936 A * 8/2000 Miller ..... 220/592.16
6,161,720 A * 12/2000 Castle ..... 220/592.17

* cited by examiner

*Primary Examiner*—Joseph M. Moy

(57) ABSTRACT

A rotation cup has a base, a first sleeve rotatably mounted on the base, a second sleeve rotatably mounted within the first sleeve and a cup securely mounted on the base and having a body portion received in the second sleeve. Because the first and the second sleeves are made of a transparent material and there are patterns on the outer periphery of the first and the second sleeves, the rotation of the first and the second sleeves is able to show various attractions to the user.

1 Claim, 2 Drawing Sheets

ROTATION CUP

CROSS REFERENCE TO THE APPLICATION

Not applicable.

BACKGROUND OF THE INVENTION

1. Field of the Invention

The present invention relates to a rotation cup, and more particularly to a rotation cup having a base, a cup body securely received in the base and two sleeves rotatably received between the base and the cup body. Each of the sleeves are provided with patterns such that when the sleeves are rotated independently, rotation of different patterns clockwise or counterclockwise will increase the attraction of the cup.

2. Description of Related Art

A conventional cup usually has only one layer of cup body and the pattern on the outer surface of the cup body is pretty dull. To improve the fun of using the cup, a rotation cup is thus introduced into the market. The rotation cup has a hollow and transparent outer wall and a inner wall rotatably received in the outer wall. Thus, when the cup of this kind is in use, the inner wall will rotate because of the moving and shaking of the cup, which does improve the fun of using the cup. However, the rotation of the inner wall is not regularly and the pattern on the surface of the inner wall can not maintain its attraction to the user due to its simple design.

Therefore, it is an objective of the invention to provide an improved rotation cup to mitigate and obviate the aforementioned problems.

SUMMARY OF THE INVENTION

It is the primary objective of the invention to provide an improved rotation cup. The rotation cup has a base, a cup body and two sleeves rotatably received between the base and the cup body. The outer surface of the cup body is made of a transparent material and each of the sleeves have its own unique pattern on its surface. Therefore, when the sleeves are rotated, clockwise or counterclockwise of the patterns will cause different effect, which really increases the fun of using the cup and is able to maintain its attraction to the user.

DETAILED DESCRIPTION OF PREFERRED EMBODIMENT

Figure 1:
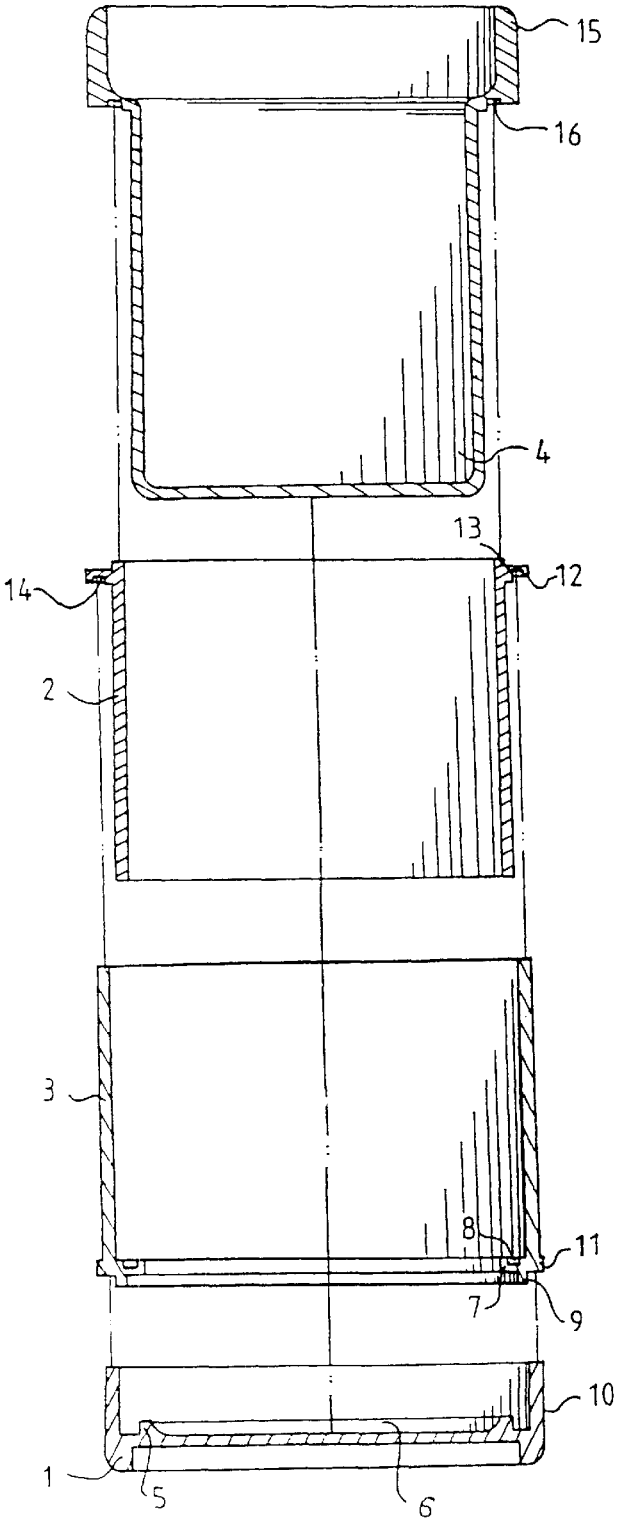
FIG. 1 is a perspective view of the rotation cup in accordance with the present invention.
Figure 2:
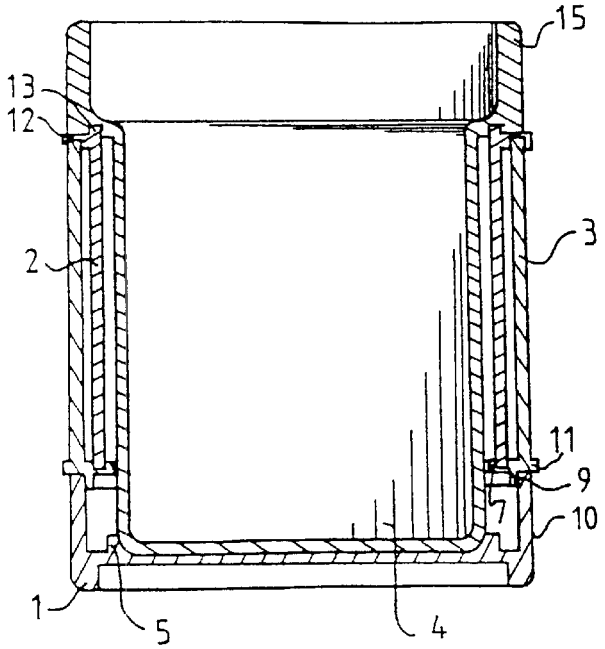
FIG. 2 is an exploded and cross sectional side view showing the parts of the rotation cup in accordance with the present invention.
Figure 3:
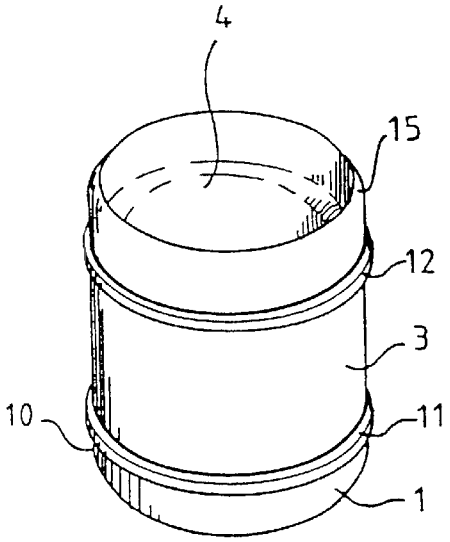
FIG. 3 is a cross sectional view showing the assembled rotation cup shown in FIG. 1.

From the accompanied drawings and especially in FIGS. 1 and 2, it is to be noted that a rotation cup in accordance with the present invention has an annular base (1) with a first flange (5) formed on the bottom face defining the annular base (1) and a recess (6) defined in the flange (5), a first hollow sleeve (3) having a seat (7) inwardly formed on a bottom face thereof, an annular groove (8) defined in the upper edge of the seat (7), an annular cutout (9) defined in the lower edge of the seat (7) and an extension (11) extending out from the seat (7), a second hollow sleeve (2) having an outer diameter smaller than that of the inner diameter of the first sleeve (3) so as that that the bottom edge (not numbered) of the second sleeve (2) is able to be inserted into the annular groove (8) of the first sleeve (3) and having a second flange (12) extending out from the upper side thereof, a step (13) formed on the upper edge thereof and an annular recess (14) defined in the bottom face of the second flange (12) and corresponding to the upper edge (not numbered) of the first sleeve (3) and a cup (4) having an enlarged heat portion (15) provided with an outer diameter the same as that of the first sleeve (3), a body portion (17) provided with an outer diameter smaller than the inner diameter of the second sleeve (2) so as to allow the body portion (17) to be inserted through the second sleeve (2) and a groove (16) defined in the bottom face of the head portion (15) to correspond to the step (13) of the second sleeve (2).

When the rotation cup of the invention is in assembly, after the first and the second sleeves (3,2) are placed on top of the base (1) with the top edge of the first sleeve (3) received in the annular recess (14) of the second sleeve (2) and the top edge of the base (1) received in the annular cutout (9), the cup (4) is inserted into the base (1) and the bottom of the cup (4) is securely engaged with the base (1) by a appropriate method known in the art. Thereafter, the first sleeve (3) and the second sleeve (2) are able to rotate separately. Due to the first and the second sleeves (3,2) are made of a transparent material, such that the rotation of the first and the second sleeves (3,2) is able to show different variations of attraction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rotation cup comprising:

an annular base with a first flange formed on the bottom face defining the annular base and a recess defined in the flange, a first hollow sleeve having a seat inwardly formed on a bottom face thereof, an annular groove defined in the upper edge of the seat, an annular cutout defined to mate with an upper edge of the base and an extension extending out from the seat, a second hollow sleeve having an outer diameter smaller than that of the inner diameter of the first sleeve so as that that a bottom edge of the second sleeve is able to be inserted into the annular groove of the first sleeve and having a second flange extending out from the upper side thereof, a step formed on an upper edge thereof and an annular recess defined in a bottom face of the second flange and corresponding to the upper edge of the first sleeve and a cup having an enlarged heat portion provided with an outer diameter the same as that of the first sleeve, a body portion provided with an outer diameter smaller than the inner diameter of the second sleeve so as to allow the body portion to be inserted through the second sleeve and a groove defined in the bottom face of the head portion to correspond to the step of the second sleeve.

* * * * *